US005259964A

United States Patent [19]

Chavez et al.

[11] Patent Number: 5,259,964

[45] Date of Patent: Nov. 9, 1993

[54] FREE-FLOWING POWDER FABRIC SOFTENING COMPOSITION AND PROCESS FOR ITS MANUFACTURE

[75] Inventors: Nahum Chavez, Estado De Mexico; Israel Oliveros, Azcapotzalco, both of Mexico

[73] Assignee: Colgate-Palmolive Co., Piscataway, N.J.

[21] Appl. No.: 838,124

[22] Filed: Feb. 19, 1992

Related U.S. Application Data

[63] Continuation-in-part of Ser. No. 809,802, Dec. 18, 1991, abandoned.

[51] Int. Cl.[5] ..... D06M 13/402

[52] U.S. Cl. ..... 252/8.6; 252/8.8; 252/541; 252/547

[58] Field of Search ..... 252/174.25, 8.9, 8.8, 252/174.15, 8.6, 541, 547

[56] References Cited

U.S. PATENT DOCUMENTS

| | | | |
|---|---|---|---|
| 3,351,483 | 11/1967 | Miner, Jr. et al. | 117/66 |
| 3,451,927 | 6/1969 | Tune et al. | 252/8.75 |
| 3,627,822 | 12/1971 | Sundby | 252/527 |
| 4,096,072 | 6/1978 | Brock et al. | 8/115.6 |
| 4,409,136 | 10/1983 | Cheng | 252/173 |
| 4,427,558 | 1/1984 | David | 252/8.75 |
| 4,686,060 | 8/1987 | Crabtree | 252/90 |
| 4,851,138 | 7/1989 | Jaroschek et al. | 252/8.8 |
| 4,968,443 | 11/1990 | Lambert et al. | 252/8.8 |

OTHER PUBLICATIONS

Database WPIL; Week 8751, Derwent Publications Ltd., London, GB; AN 87-359915 & JP-A-62-263379 (Kao Corp.) 16 Nov. 1987-abstract.

*Primary Examiner*—Anthony McFarlane

*Attorney, Agent, or Firm*—Bernard Lieberman; Robert C. Sullivan

[57] ABSTRACT

A free-flowing, spray-dried, particulate rinse cycle fabric softening composition and a method of its use are described. The composition comprises designated amount of quaternary ammonium softening compound, a detergent compound, urea and water.

11 Claims, No Drawings

FREE-FLOWING POWDER FABRIC SOFTENING COMPOSITION AND PROCESS FOR ITS MANUFACTURE

This application is a continuation-in-part of U.S. Ser. No. 07/809,802 filed Dec. 18, 1991, now abandoned, the disclosure of which is incorporated herein by reference.

This invention relates to a free-flowing, spray-dried concentrated particulate fabric softening composition which is readily dispersible in water and to a process for its manufacture and use. More particularly, the present invention relates to an effective fabric softening composition in a form which is convenient for use, capable of containing a relatively high proportion of cationic fabric softener, and can be economically packaged and shipped.

Fabric softening or conditioning compositions for use in household washing machines are marketed extensively in the United States and Europe. Generally, these compositions are aqueous liquids containing as the principal active ingredient a cationic quaternary ammonium compound to impart a softening effect to fabrics treated therewith in the laundry bath. Typically, these fabric softeners (the common designation for such softening compositions) contain from about 5 to 8% of the active cationic softening compound. In a United States washing machine containing about 65 liters of water, normally about 90 grams of a 6% active liquid fabric softener is added to the rinse cycle to achieve an acceptable softening level.

Liquid fabric softeners, however, have certain inherent disadvantages. The level of the active cationic quaternary ammonium compound capable of being introduced into an aqueous system is generally limited by properties of solubility of the quaternary compound and stability and pourability of the final product. Conventional rinse-added fabric softening compositions contain quaternary ammonium compounds, typically having two long alkyl chains, which are substantially water-insoluble materials. The softening compositions are, therefore, normally in the form of an aqueous dispersion or emulsion. Consequently, at higher concentrations of the active cationic softening compound, generally above about 6%, by weight, problems in product formulation, stability (i.e. product separation), gel-formation and water dispersibility are likely to occur. At concentrations above about 9%, by weight, of quaternary ammonium compounds, the viscosity and stability of the aqueous liquid softener are often unacceptable for commercial purposes.

There are also economic disadvantages associated with marketing liquid fabric softeners. These primarily relate to the substantial costs of packaging and shipping bottles of a dilute aqueous liquid product containing a relatively low level of active softening ingredient. The packaging also poses a problem from an environmental standpoint. The manufacture and disposal of plastic containers, which are commonly used for liquid household products are often incompatible with consumer demands in the United States and Europe for the use of recyclable packaging materials which are readily biodegradable. Accordingly, there is a need in the art for a fabric softening composition in particulate form capable of containing relatively high concentrations of active softening ingredients and capable of being supplied in an economically packaged form.

Fabric softeners in powdered form are described in the patent literature. In U.S. Pat. No. 2,940 816 there is described a powdered fabric softener comprised of a defined quaternary ammonium compound in combination with urea. U.S. Pat. No. 3,256,180 describes a process for producing a fabric softener which comprises reacting urea with a quaternary ammonium compound in the presence of water to form a granular product. U.S. Pat. Nos. 3,356,526 and 3,573,091 to Woldman et. al. relate to a process for preparing a powdered quaternary softener wherein a solution of the quaternary ammonium compound is sprayed onto a particulate carrier, such as urea or sodium tripolyphosphate, so as to provide particles of carrier having a coating of the softener.

U.S. Pat. No. 4,427,558 to David discloses fabric softening particles comprised of a quaternary ammonium compound, urea, and a calcium soap such as calcium tallow soap. The process of preparation comprises forming a liquid mixture of the desired components, cooling the liquid to form a solid and then grinding to form particles. Prior to grinding, the solid is "weathered" for several hours, the term "weathering" being used to describe the process of allowing the water content of the particles to approach equilibrium with the environment. Particles may also be formed, according to the disclosure, by "spray cooling" a liquid mixture whereby a solid is formed with no accompanying loss of water. The resulting solid is then ground and weathered.

In European Patent Application EP 1315 (Procter & Gamble) there is described a process whereby molten particles of a quaternary ammonium compound and a dispersion inhibitor such as a fatty alcohol or fatty acid are attached to spray-dried base detergent granules containing surfactant and builder. The emphasis in this as well as other patents in the literature is to avoid dispersing the cationic softening compound in the wash water in order to prevent its inactivation in the wash solution. In those patents which seek to provide a quaternary ammonium compound in the form of a readily dispersible powder in cold water, with particular emphasis on rinse-cycle applications, such dispersibility has remained a problem, particularly at higher concentrations of the quaternary compounds.

It has now been discovered that a highly concentrated particulate fabric softening composition can be prepared in accordance with the invention by a spray drying process which provides particles of a softening composition containing up to about 40% of a cationic softening compound in combination with a nonionic and/or an anionic surfactant, among other components, which particles are readily dispersible in water and provide effective softening.

SUMMARY OF THE INVENTION

Accordingly, the present invention provides a free-flowing spray-dried particulate fabric softening composition which is readily dispersible in water comprising:

(a) from about 5 to 40%, by weight, of a cationic quaternary ammonium softening compound;

(b) from about 0.5 to 15%, by weight, of an anionic and/or a nonionic detergent compound; and (c) from about 45 to 85%, by weight, of urea; the balance being water.

In a preferred embodiment of the invention the composition further contains from about 1 to 10%, by weight, of a fatty acid alkanolamide.

The invention also encompasses a process of producing a free-flowing spray-dried particulate fabric softening composition which is readily dispersible in water comprising:

(a) forming a crutcher slurry containing:
  (i) from about 5 to 40%, by weight, of a cationic quaternary ammonium softening compound;
  (ii) from about 0.5 to 15%, by weight, of an anionic and/or a nonionic detergent compound;
  (iii) from about 1 to 10%, by weight, or an alkanolamide; and
  (iv) from about 45 to 85%, by weight, of urea, the above percentages being based on the solids content of the slurry, in the absence of water;

(b) mixing the crutcher slurry formed in step (a) such that a uniform mixture or dispersion is formed having an average particle size of less than about 1.0 micron and thereafter;

(c) spray drying the aforesaid mixture or dispersion in a spray tower wherein the water content of the mixture is substantially evaporated to provide free-flowing particles of a softening composition capable of being readily dispersed in water.

The invention is predicated on the discovery that a fabric softening composition can be prepared in particulate form by spray drying to provide a composition more highly concentrated than conventional liquid rinse-cycle softeners. The resulting spray dried particles are dispersible in water and provide effective softening to fabrics in a rinse cycle aqueous bath. An essential feature of the composition of the invention is that uniform spray dried particles are formed by utilizing a mixing step prior to spray drying the crutcher slurry such that the contents of the crutcher slurry are thoroughly dispersed and form a mixture or dispersion having an average particle size of below about 1.0 micron. Uniform mixtures of this type may be achieved with various types of mixers, mills or pumps known in the art, but it is preferred to use a so-called "homogenizer" such as a Gaulin Homogenizer marketed by Gaulin Corporation of Everett, Mass. U.S.A. or Hilversum, Holland, which consists essentially of a positive displacement pump to which is attached a homogenizing valve assembly capable of providing an intimate mixture having an average particle size diameter of below about 1.0 microns, and more preferably below about 0.75 microns. The preferred maximum size of particles in such mixture is below about 5.0 microns and more preferably below about 3.0 microns.

DETAILED DESCRIPTION OF THE INVENTION

The process of spray drying a softening composition in accordance with the invention utilizes, for the most part, well known technology relating to the production of particulate detergent compositions. Generally, an aqueous crutcher slurry is formed containing a mixture of water with many or most of the ingredients desired in the fabric softening composition. The solids content of the slurry is generally from about 20% to about 70%, preferably 30% to 60%, and most preferably from 40% to 50% thereof, the balance being water. The crutcher slurry is then atomized by pumping it an atomizing nozzle at a pressure of about 1000 to 2000 psi into a spray-drying tower, the typical dimensions of a commercial tower being about 35-100 feet in height and about 12-30 feet in diameter. At the base of the tower, air is introduced at a temperature of from about 300°-1000° F. which contacts the atomized slurry to provide a hot drying gas for the droplets of the slurry thereby evaporating most of the water. The resulting particles or beads are collected at the bottom of the tower, the moisture and heated air existing at the top. Heat or water-sensitive ingredients such as perfume may be post-added to the tower particles in a subsequent mixing or blending operation.

The crutcher slurry is preferably made by sequentially adding the various components thereof in the manner which will result in the most miscible and readily pumpable slurry for spray drying. The order of addition of the various components may be varied, depending on the circumstances. Normally, it is preferable for all or almost all of the water to be added to the crutcher first, preferably at about the processing temperature, after which the other components are added in sequence namely, urea, the quaternary ammonium softening compound, anionic and/or nonionic surfactants, a fatty acid alkanolamides and optionally adjuvants, such as pigments, anti-oxidants and germicides.

The temperature of the aqueous medium in the crutcher will usually be about room temperature or elevated, normally being in the 20° to 70° C. range, and preferably from about 25° to 40° C.

Crutcher mixing times to obtain thoroughly mixed homogeneous slurries can vary widely, from as little as five minutes in small crutchers and for slurries of higher moisture contents, to as much as one hour, in some cases, although 30 minutes is a preferably upper limit. Following mixing in the crutcher, the crutcher slurry is transferred for further mixing to a "homogenizer" or similar mixer or pump to obtain the uniform dispersion or mixture described above having an average particle size of below about 1.0 micron.

The resulting dispersion is thereafter transferred in the usual manner to a spray drying tower, which is located near the crutcher. The dispersion is forced at high pressure through spray nozzles into the spray tower (countercurrent or concurrent), wherein the droplets of the slurry fall through a hot drying gas to form particles or beads of the fabric softening composition while evaporating substantially all the water. The moisture content of the particles is preferably about 2 to 4%, by weight.

The cationic quaternary ammonium softening compounds useful for the invention include imidazolinium salts, di-long chain alkyl quaternary ammonium salts and diesterified long chain fatty acid dilower alkyl quaternary ammonium salts. The general structure of the preferred imidazolinium salts is shown below:

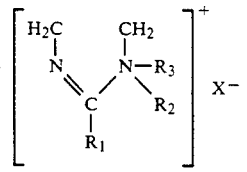

(1)

wherein:

$R_1$ is a $C_8$ to $C_{30}$ aliphatic radical and preferably a $C_{14}$ to $C_{18}$ alkyl or alkenyl;

$R_2$ and $R_3$ independently may be any of $R_1$ or preferably, lower alkyl or substituted alkyl of $C_1$ to $C_4$ such as haloalkyl, hydroxyalkyl, acylaminoalkyl and the like;

X is a water-solubilizing anion such as chloride, bromide, iodide, fluoride. sulfate, methosulfate, nitrite, nitrate, phosphate and carboxylate, (e.g. acetate, adipate, phthalate, benzoate, oleate, etc.).

Typical imidazolinium softening compounds include:

2-heptadecyl-1-methyl-1-oleylamidoethyl imidazolinium ethosulfate 2-heptadecyl-1-methyl-1-(2-stearoylamido)ethyl-imidazolinium sulfate, 2-heptadecyl-1-methyl-1-(2-stearoylamido)ethyl-imidazolinium chloride, 2-coco-1-(2-hydroxyethyl)-1-benzyl imidazolinium chloride, 2-coco-1-(hydroxyethyl)-1-(4-chlorobutyl) imidazolinium chloride, 2-coco-1-(2-hydroxyethyl)-1-octadecenyl imidazolinium chloride, 2-tall oil fatty-1-(2-hydroxyethyl)-1-benzyl imidazolinium chloride, 2-tall oil fatty-1-(2-hydroxyethyl)-1-(4-chlorobutyl)-imidazolinium chloride, 2-heptadecenyl-1-(2-hydroxyethyl)-1-(4-chlorobutyl)-imidazolinium chloride, 2-heptadecenyl-1-(2-hydroxyethyl)1-benzyl imidazolinium chloride, 2-heptadecyl-1-(hydroxyethyl)-1-octadecyl imidazolinium ethyl sulfate.

The general structure of the di-long chain alkyl quaternary ammonium salts is shown below:

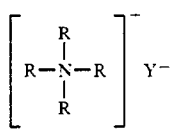

(2)

wherein the R groups are selected from $C_1$ to $C_{30}$aliphatic, preferably alkyl or alkenyl; aryl (e.g. phenyl, toloyl, cumyl, etc.); aralkyl (e.g. benzyl, phenethyl, methylbenzyl, etc.); and the halo, amide, hydroxyl, and carboxy sustituents thereof such as halo $C_2$ to $C_6$ alkyl (e.g. 2-chloroethyl); and hydroxy $C_2$ to $C_6$ alkyl (e.g. 2-hydroxyethyl); with the proviso that at least two R's are $C_{12}$ to $C_{30}$ and preferably $C_{12}$ to $C_{22}$ and the others are lower alkyl; more preferably at least two R's are $C_{12}$ to $C_{18}$ and the others are lower alkyl of $C_1$ to $C_4$ (and most preferably methyl or ethyl) and Y is an anion as defined for X in Formula (1).

Typical quaternary ammonium salts of formula (2) include the following:

distearyl dimethyl ammonium chloride ditallow dimethyl ammonium chloride dihexadecyl dimethyl ammonium chloride distearyl dimethyl ammonium bromide di(hydrogenated tallow) dimethyl ammonium bromide distearyl, di(isopropyl) ammonium chloride distearyl dimethyl ammonium methosulfate.

di (hydrogenated tallow) dimethyl ammonium methosulfate.

Another preferred class of the cationic fabric softeners are diesterified long chain fatty acid dilower alkyl quaternary ammonium salts and diesterified long chain fatty acid lower alkyl lower hydroxy alkyl quaternary ammonium salts. This class of cationic fabric softeners can be represented by the general formula:

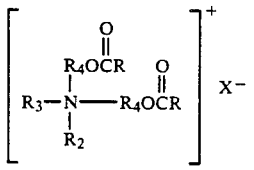

wherein RCO represents the residue of a fatty acid having from about 12 to 24 carbon atoms;

$R_2$ and $R_3$ represent indpendently a lower alkyl group or a hydroxyalkyl group having 1 to 4 carbon atoms, and preferably 1 to 3 carbon atoms;

$R_4$ represents a lower alkylene group having 1 to 4 carbon atoms, preferably 1 to 3, and most preferably has 2 carbon atoms, i.e. $R_4$ is $—CH_2CH_2—$; and X is a water solubilizing anion as defined above. Such compounds are commercially available from, for instance, Stepan Chemical Co. under the Stepantex trademark, such as Stepantex VHR90 which has the formula:

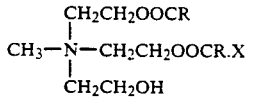

where RCO is derived from tallow or coco fatty acids and X may be chloride or sulfate.

The quaternary ammonium softening compound is generally from about 5 to 40%, by weight, of the particulate softening composition, preferably from about 10 to 30%, and most preferably from about 15 to 25%, by weight.

An optional fabric softening ingredient is a fatty alcohol wherein the hydrophobic group may be a straight or branched chain alkyl or alkenyl group having from about 10 to 24, preferably from about 10 to 20, especially preferably from about 12 to 20 carbon atoms. Specific examples of the fatty alcohol include decanol, dodecanol, tetradecanol, pentadecanol, hexadecanol, octadecanol, lauryl alcohol, palmityl alcohol, stearyl alcohol, oleyl alcohol, and mixtures thereof. Furthermore, the fatty alcohol may be of natural or synthetic origin and may include, for example, mixed alcohol, such as $C_{16}$ to $C_{18}$ alcohols prepared by Ziegler polymerization of ethylene.

The fatty alcohol may be present in the composition in a minor amount relative to the cationic fabric softener such that the ratio, by weight, of the cationic fabric softener to fatty alcohol is in the range of from about 6:1 to 2:1, especially preferably about 5:1 to 3:1.

The fatty acid alkanolamide useful in the present invention are those derived from fatty acid amides whose alkyl radical contains at least 12 carbon atoms. They preferably have the general formula:

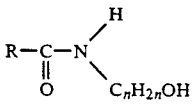

wherein n is 2 or 3. A preferred material is coco monoethanolamide.

The concentration of fatty acid alkanolamide in the softening composition is generally from about 1 to 10%, by weight, and preferably from about 1 to 5%, by weight. The combination of fatty acid alkanolamide and quaternary ammonium softening compound in accordance with the invention provides a superior softening effect to fabrics.

An essential component of the fabric softening composition is urea. The particles generally contain from about 45 to 85%, by weight, of urea, preferably from about 55 to 75%, and most preferably from about 60 to 70%, by weight.

Another important ingredient for purposes of improving particle solubility and dispersibility is an anionic and/or nonionic surfactant. Among the anionic surface active agents useful in the present invention are those surface active compounds which contain an organic hydrophobic group containing from about 8 to 26 carbon atoms and preferably from about 10 to 18 carbon atoms in their molecular structure and at least one water-solubilizing group selected from the group of sulfonate, sulfate, carboxylate, phosphorate and phosphate so as to form a water-soluble detergent.

Examples of suitable anionic detergents include soaps, such as, the water-soluble salts (e.g., the sodium potassium, ammonium and alkanolammonium salts) of higher fatty acids or resin salts containing from about 8 to 20 carbon atoms and preferably 10 to 18 carbon atoms. Particularly useful are the sodium and potassium salts of the fatty acid mixtures derived from coconut oil and tallow, for example, sodium coconut soap and potassium tallow soap.

The anionic glass of detergents also includes the water-soluble sulfated and sulfonated detergents having an aliphatic, preferably an alkyl radical containing from about 8 to 26, and preferably from about 12 to 22 carbon atoms. Examples of the sulfonated anionic detergents are the higher alkyl aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates and hydroxyalkane sulfonates.

Other suitable anionic detergents are sulfated ethoxylated higher fatty alcohols of the formula $RO(C_2H_4O)_mSO_3M$, wherein R is a fatty alkyl of from 10 to 18 carbon atoms, m is from 2 to 6 (preferably having a value from about 1/5 to ½ the number of carbon atoms in R) and M is a solubilizing salt-forming cation, such as an alkali, ammonium, lower alkylamino or lower alkanolamino, or a higher alkyl benzene sulfonate wherein the higher alkyl is of 10 to 15 carbon atoms. The proportion of ethylene oxide in the polyethoxylated higher alkanol sulfate is preferably 2 to 5 moles of ethylene oxide groups per mole of anionic detergent, with three moles being most preferred, especially when the higher alkanol is of 11 to 15 carbon atoms. A preferred polyethoxylated alcohol sulfate detergent is marketed by Shell Chemical Company as Neodol 25-3S.

The most highly preferred water-soluble anionic detergent compounds are the ammonium and substituted ammonium (such as mono, di and triethanolamine), alkali metal (such as, sodium and potassium) and alkaline earth metal (such as, calcium and magnesium) salts of the higher alkyl benzene sulfonates, olefine sulfonates and higher alkyl sulfates. Among the above-listed anionics, the most preferred are the sodium linear alkyl benzene sulfonates (LABS), and especially those wherein the alkyl group is a straight chain alkyl radical of 12 or 13 carbon atoms.

Among the suitable nonionic surfactants are the ethoxylated fatty alcohols having from 12 to 20 carbon atoms, and an average degrees of ethoxylation of 3 to 9. Preferred nonionic detergents are coconut alcohols having an average of 6 or 7 ethyoxy groups per molecule and $C_{14}$–$C_{15}$ primarily alcohols with 6 or 7 ethoxy groups per mole of higher fatty alcohol. Ethoxylated lauryl alcohol having about 7 moles of ethoxylate per mole of alcohol is particularly preferred for use herein.

Other useful nonionic detergent compounds include the alkylpolyglycoside and alkylpolysaccharide surfactants which are well known in the art.

The amount of anionic surfactant in the particulate composition may vary from 0 to 8%, and preferably will vary with the percentage of cationic softening compound as follows: from about 1 to 4% of anionic surfactant when the percentage of cationic compound is below about 20%, and from about 3 to 8% of anionic surfactant when the percentage of cationic softening compound is from about 20 to 40%, all percentages being by weight of the particulate composition. Generally, the level of anionic surfactant is from about 2 to 4%, by weight. The nonionic surfactant is optionally present from about 0.5 to 5%, by weight, and preferably no more than about 1%, by weight.

The fabric softening compositions of the invention may further include additional or supplemental ingredients which do not adversely affect the stability or functional characteristics of the softening composition. Included among such supplemental ingredients are perfumes, dyes, pigments, germicides, soil-release agents, fabric crisping agents, anti-oxidants and anti-corrosion agents.

EXAMPLE 1

A granular fabric softening composition of the invention had the following composition:

| Component | Weight Percent |
|---|---|
| DSDMAC[1] | 24 |
| Nonionic Surfactant[2] | 2 |
| Sodium Dodecyl Benzene Sulfonate | 3 |
| Cocomonoethanol Amide | 3 |
| Urea | 64 |
| Moisture | Balance |

[1]Distearyl dimethyl ammonium chloride
[2]Ethoxylated lauryl alcohol having about 7 moles of ethoxylate per mole of alcohol.

Ten and one-half grams of the above-described softening composition was added to a top-loaded washing machine in the rinse cycle at a water temperature of 25° C. and at water hardness of 100 and 320 ppm. The dispersibility time of the granular product in the water was about 1.5 minutes.

The softness and hydrophilicity of the resulting fabrics was measured and compared with the measured softness for fabrics conditioned in the same top loading machine with forty two grams of a commercial liquid fabric softener containing 6% of a quaternary ammonium softener. The fabrics conditioned with the granular softening composition of the invention were measurably softer and equal in hydrophilic properties to those conditioned with the commercial liquid product.

We claim:

1. A free-flowing, spray-dried, particulate rinse cycle fabric softening composition which is readily dispersible in water comprising:

(a) from about 5 to 40%, by weight, of a cationic quaternary ammonium softening compound;

(b) from about 0.5 to 15%, by weight, of a member selected from the group consisting of an anionic detergent compound, a nonionic detergent compound and mixtures thereof; and (c) from about 45 to 85%, by weight, of urea; the balance being water.

2. The fabric softening composition of claim 1 further containing from about 1 to 10%, by weight, of a fatty acid alkanolamide.

3. The fabric softening composition of claim 2 wherein said alkanolamide is cocomonoethanol amide.

4. The fabric softening composition of claim 1 comprising from about 1 to 8% of an anionic detergent compound and from about 10 to 40% of a cationic softening agent, all percentages being by weight of the composition.

5. The fabric softening composition of claim 4 wherein the percent of anionic detergent varies with the percent of cationic compound as follows: from about 1 to 4% of anionic detergent when the percent of cationic softening compound is below about 20%, and from about 3 to 8% of anionic detergent when the percent of cationic softening compound is from about 20 to 40%, all percentages being by weight of the composition.

6. The fabric softening composition of claim 5 wherein the anionic detergent compound is dodecylbenzene sulfonate.

7. The fabric softening composition of claim 1 which comprises up to about 2% by weight of a nonionic detergent compound.

8. The fabric softening composition of claim 1 wherein said nonionic detergent compound is ethoxylated lauryl alcohol.

9. The fabric softening compound of claim 1 wherein said cationic softening compound is distearyl dimethyl ammonium chloride.

10. A method for softening fabrics comprising rinsing the fabrics in an aqueous bath containing an effective amount of a dispersed spray-dried particulate rinse cycle fabric softening composition comprised of the following components:

(a) from about 5 to 40%, by weight, of a cationic quaternary ammonium softening compound;

(b) from about 0.5 to 15%, by weight, of a member selected from the group consisting of an anionic detergent compound, a nonionic detergent compound and mixtures thereof; and (c) from about 45 to 85%, by weight, of urea; the balance being water.

11. A method according to claim 10 wherein the fabric softening composition further contains from about 1 to 10%, by weight, of a fatty acid alkanolamide.

* * * * *